United States Patent [19]

Lux et al.

[11] 4,035,901

[45] July 19, 1977

[54] APPARATUS FOR JOINING TWO ABUTTING METAL MEMBERS TOGETHER AND METHOD OF MAKING SUCH APPARATUS

[75] Inventors: Joseph W. Lux; John M. Varanelli, both of Waterbury, Conn.

[73] Assignee: Robertshaw Controls Company, Richmond, Va.

[21] Appl. No.: 707,780

[22] Filed: July 22, 1976

[51] Int. Cl.[2] ..... B23P 11/00

[52] U.S. Cl. ..... 29/243.5; 29/756; 29/432.1; 72/356

[58] Field of Search ..... 29/243.5, 200 B, 203 D, 29/432.1, 509, 33 M, 566, 33 K, 565; 10/11 A; 72/356

[56] References Cited

U.S. PATENT DOCUMENTS 1,456,079 5/1923 Stuebner ..... 29/432.1

*Primary Examiner*—James L. Jones, Jr.

*Attorney, Agent, or Firm*—Candor, Candor & Tassone

[57] ABSTRACT

An apparatus for joining two abutting metal members together by lancing and forming a part of one member through an unblanked part of the other member and thereafter staking the lanced and formed part of the one member to an adjacent surface of the other member to secure the members together in abutting relation, the apparatus having a single reciprocating head provided with a first section that performs the lancing and forming step on a first stroke of the head and provided with a second section that performs the staking step on a second stroke thereof.

10 Claims, 13 Drawing Figures

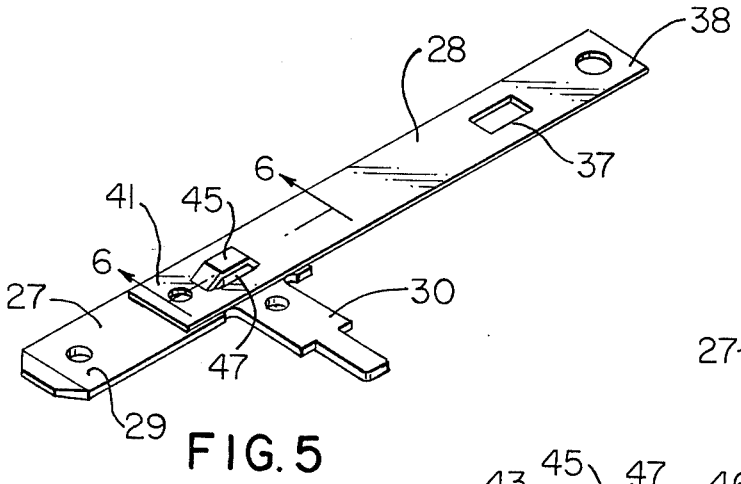
FIG. 5
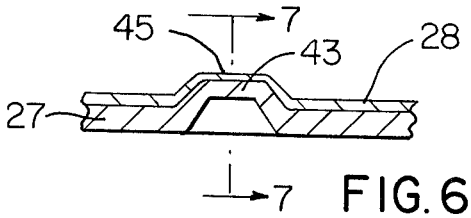
FIG. 6
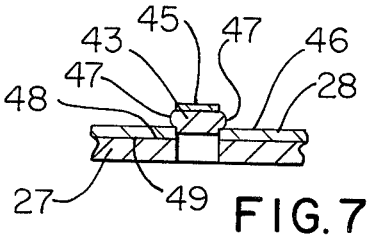
FIG. 7
FIG. 8
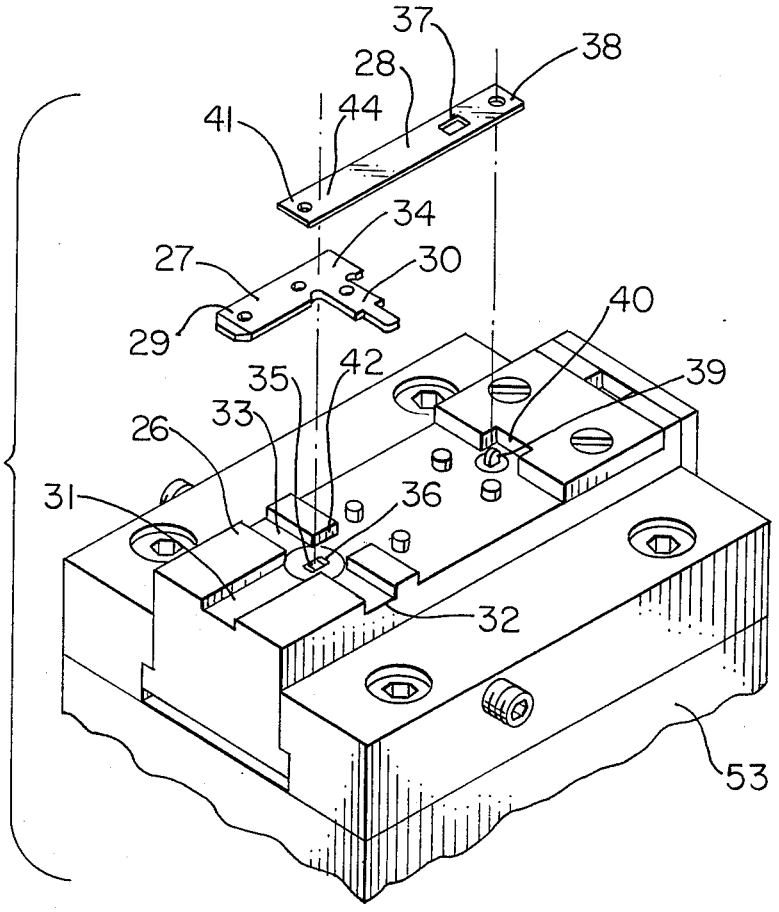

APPARATUS FOR JOINING TWO ABUTTING METAL MEMBERS TOGETHER AND METHOD OF MAKING SUCH APPARATUS

This invention relates to an improved apparatus for joining two abutting metal members together by lancing, forming and staking operations and to a method for making such an apparatus.

It is well known that a pair of abutting metal members can be joined together by lancing and forming a part of one member through an unblanked part of the other member and thereafter staking the lanced and formed part of the one member to an adjacent surface of the other member to secure the members together in abutting relation.

For example, see the U.S. patent to Hasner, U.S. Pat. No. 3,924,378 wherein such a joining operation is provided by an apparatus having two separately actuatable rams, one of the rams carrying a lancing and forming die and the other ram carrying a flatening punch or anvil whereby the one ram performs the lancing and forming operation and the other ram forms the staking operation.

It is a feature of this invention to provide an apparatus for so securing together two abutting metal members wherein the same head of the apparatus first performs the lancing and forming operation on one stroke thereof and thereafter forms the staking operation on the second stroke thereof.

In particular, one embodiment of this invention provides an apparatus for joining two abutting metal members together by lancing and forming a part of one member through an unblanked part of the other member and thereafter staking the lanced and formed part of the one member to an adjacent surface of the other member to secure the members together in abutting relation, the apparatus having a single reciprocating head provided with a first means to perform the lancing and forming step on a first stroke of the head and provided with a second means that performs the staking operation of the second stroke of the head.

Accordingly, it is an object of this invention to provide an improved apparatus having one or more of the novel features set forth above or hereinafter shown or described.

Another object of this invention is to provide a method of making such an apparatus or the like, the method of this invention having one or more of the novel features set forth above or hereinafter shown or described.

Other objects, uses and advantages of this invention are apparent from a reading of this description which proceeds with reference to the accompanying drawings forming a part thereof and wherein:

FIG. 5 is a perspective view illustrating two metal members joined by the apparatus of FIG. 1.

FIG. 6 is an enlarged, fragmentary, cross-sectional view taken on lines 6—6 of FIG. 5.

FIG. 7 is a fragmentary cross-sectional view taken on line 7—7 of FIG. 6.

FIG. 8 is an exploded perspective view of the part receiving section of the apparatus of FIG. 1.

Figure 1:
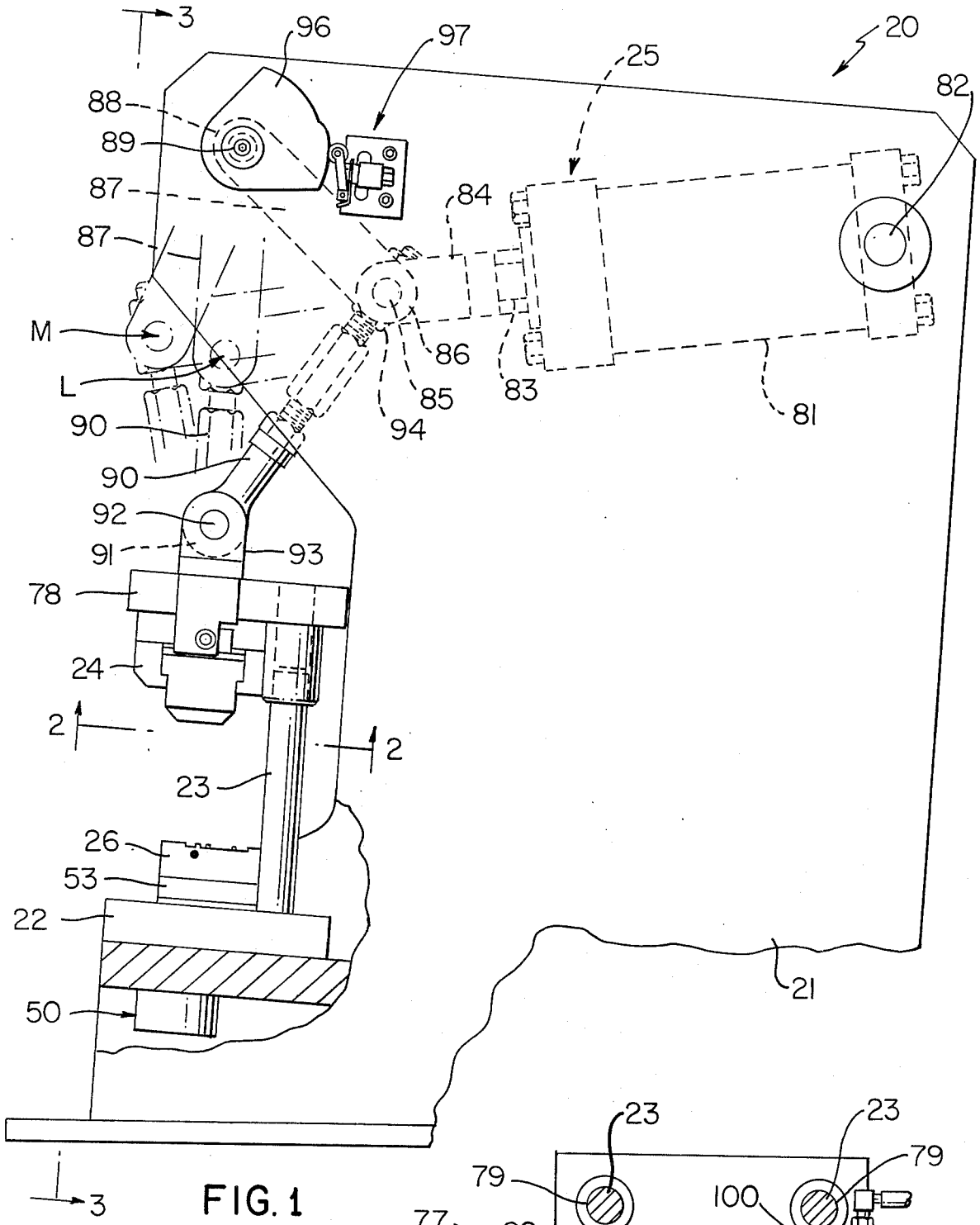
FIG. 1 is a schematic side view illustrating the improved apparatus of this invention.

While the various features of this invention are hereinafter described and illustrated as being particularly adapted to secure a switch blade member to a terminal member for subsequently making an electrical switch, it is to be understood that the various features of this invention can be utilized singly or in any combination thereof to provide a joining operation for other types of members formed of materials other than metal, as desired.

Therefore, this invention is not to be limited to only the embodiment illustrated in the drawings, because the drawings are merely utilized to illustrate one of the wide variety of uses of this invention.

Figure 3:
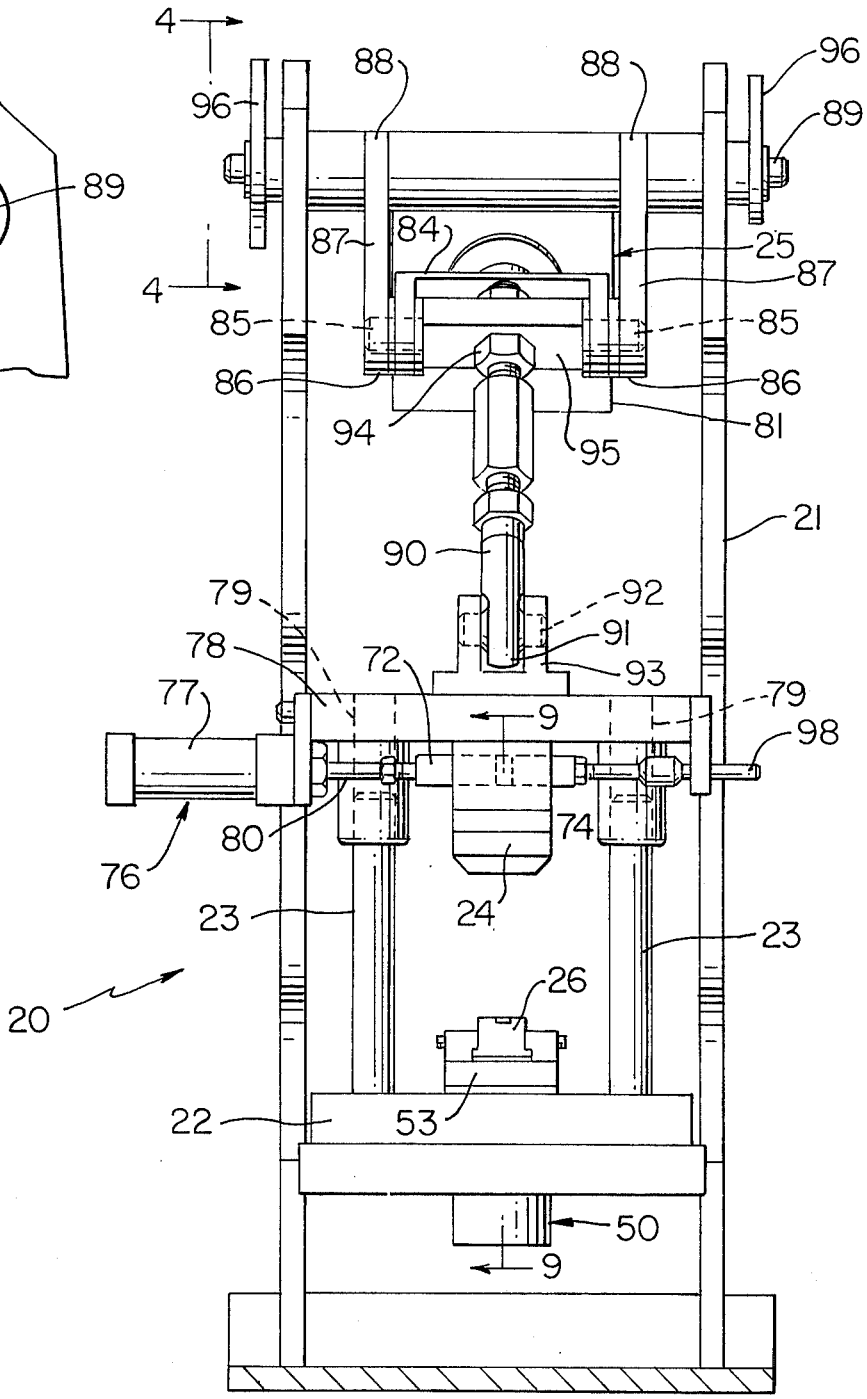
FIG. 3 is a front view of the apparatus of FIG. 1 and is taken substantially in the direction of the arrows 3—3 of FIG. 1.

Referring now to FIGS. 1 and 3, the improved apparatus of this invention is generally indicated by the reference numeral 20 and comprises a frame means 21 carrying a base 22 supporting a pair of substantially vertically extending posts 23 on which a reciprocating head 24 is adapted to be moved upwardly and downwardly in a straight line in a manner hereinafter described by a piston and cylinder device that is generally indicated by the reference numeral 25, the reciprocating head 24 being adapted to cooperate with a part-receiving block 26 movably carried on the base 22 to join together a pair of abutting metal members 27 and 28, FIG. 8, in a manner hereinafter described.

As illustrated in FIG. 8, the metal member 27 can comprise a relatively rigid terminal member for an electrical switch and the metal member 28 can comprise a relatively thin and resilient switch blade for such electrical switch construction as fully disclosed in the copending patent application Ser. No. 613,634 filed Sept. 15, 1975, and assigned to the same assignee to whom this application is assigned.

The terminal part 27 illustrated in FIG. 8 is adapted to be placed in the block 26 of the apparatus 20 so that the two legs 29 and 30 thereof are received in recess means 31 and 32 or 31 and 33 of the die block 26 whereby the unblanked part 34 thereof will be disposed over a stationary punch member 35 that is carried by the base 21 and is adapted to project out of an opening 36 of the block 26 in a manner hereinafter described.

The switch blade 28 is thereafter adapted to be assembled into the block 26 by having an opening 37 in the end 38 thereof receiving a locating member 39 of the block 26 so that the other end 41 of the blade 28 will be positioned over the unblanked part 34 of the terminal 27 and be held in a cutout or recess 42 formed in the block 26 whereby the assembled parts 27 and 28 will be in the assembled positional relation illustrated in FIG. 5, FIG. 5 illustrating the parts 27 and 28 secured together after the lancing, forming and staking operations of the apparatus 20 have taken place.

In particular, the apparatus 20 is adapted to punch and lance the part 43, FIGS. 5, 6 and 7, of the terminal member 27 into an unblanked part 44 of the switch blade 28 to lance a part 45 therefrom so that the lanced part 43 of the terminal member 27 has the majority of the cross-section thereof disposed above the top surface 46 of the switch blade 28 in a manner illustrated in FIG. 7. Thereafter, the apparatus 20 causes the lanced part 43 of the terminal member 27 to be compressed and thereby staked outwardly at the reference numerals 47 in FIG. 7 to be disposed against the side 46 of the switch blade 28 and thereby secure the terminal member 27 and switch blade 28 together at the abutting surfaces 48 and 49 thereof as illustrated in the drawings and as fully illustrated, described and claimed in the aforementioned co-pending patent application.

Figure 9:
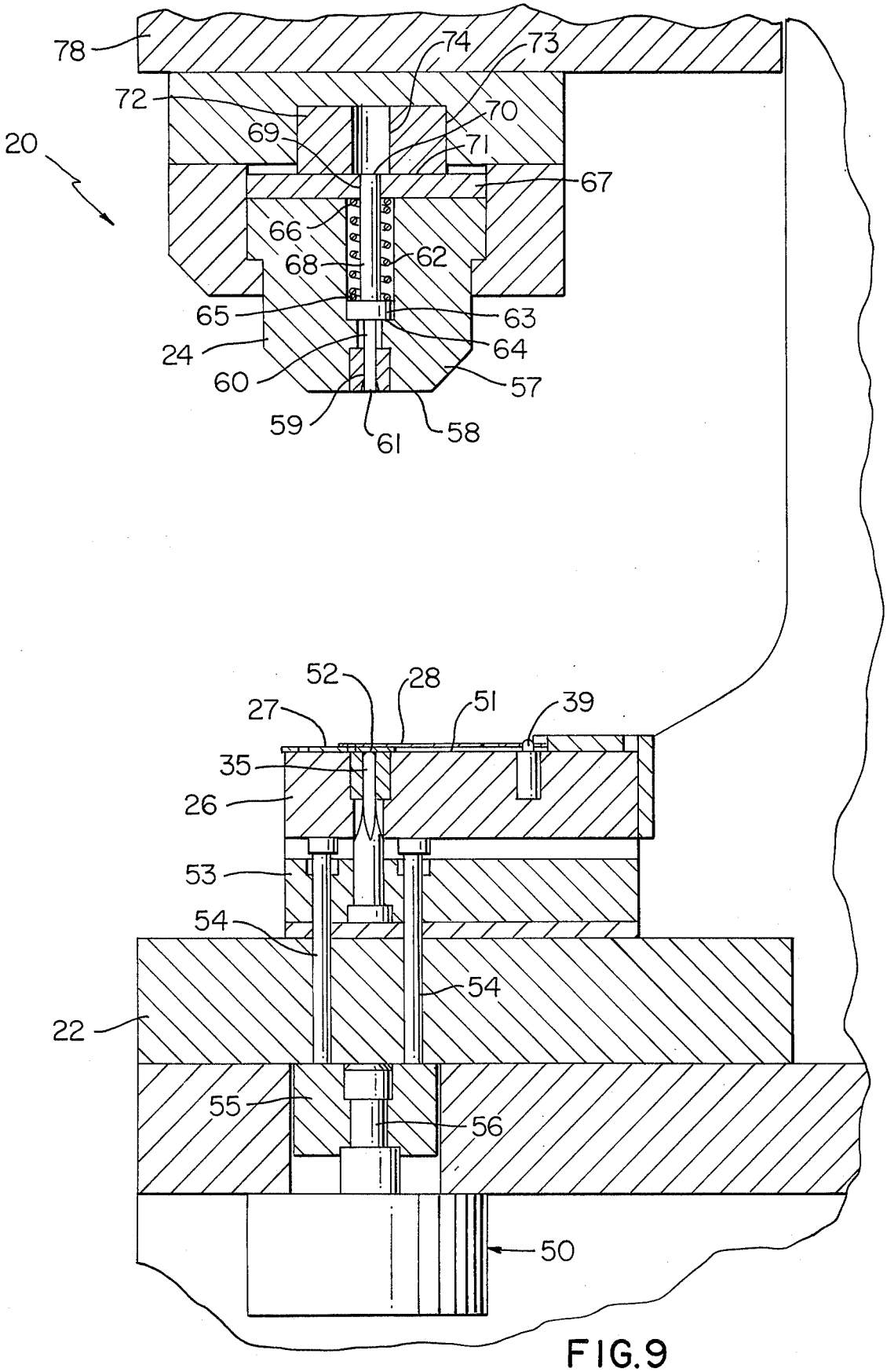
FIG. 9 is an enlarged, fragmentary, cross-sectional view of the apparatus of FIG. 1 and is taken substantially on the line 9—9 of FIG. 3.

When the terminal member 27 and switch blade 28 are first assembled into the block 26 of the apparatus 20 in the manner illustrated in FIG. 9, the block 26 is being held upwardly relative to the base 22 by a piston and cylinder device 50 so that a top surface 51 of the block 26 is disposed substantially flush with the top 52 of the forming punch 35 which is disposed in a fixed position on the base 22 by a holding block 53 as illustrated in FIG. 9. However, the block 26 is carried on a pair of rods 54 which are movable in the base 22 and are interconnected by a block 55 to the piston 56 of the piston and cylinder device 50 so that when the piston 56 is extended upwardly in the manner illustrated in FIG. 9, the block 26 is held in its up position with its top surface 51 flush with the top surface 52 of the punch 35 to facilitate the loading of the parts 27 and 28 therein as well as for stripping the completed assembly of the parts 27 and 28 from the block 26 as will be apparent hereinafter.

The head 24 of the apparatus 20 as best illustrated in FIG. 9 includes a female die member 57 provided with a lower flat surface 59 interrupted by a substantially rectangular opening 59 which will cooperate with the part 35 to lance and form the parts 43 and 45 of the members 27 and 28 in the manner illustrated in FIG. 6 in a manner hereinafter described.

A staking or anvil member 60 is disposed in the opening 59 of the female die member 57 and has a lower end 61 normally being biased by a compression spring 62 to a position that is flush with the end surface 58 of the female die member 57 as illustrated in FIG. 9 as the spring 62 tends to force a disc end member 63 of the staking member 60 against a shoulder 64 of the female die member 57 as illustrated, the compression spring 62 having one end 65 bearing against the end 63 of the staking member 60 and the other end 66 thereof bearing against a plate member 67 of the head 24 as illustrated.

The staking member 60 has a rod portion 68 extending upwardly from the disc-end member 63 thereof and being adapted to project through an opening 69 in the plate 67 to have its end 70 disposed flush with an upper surface 71 of the plate 67 when the disc-end member 63 is disposed against the shoulder 64 as illustrated in FIG. 9.

In this manner, a sliding block 72 disposed for substantially horizontal movement in a rectangular opening 73 in the head 24 can pass over the end 70 of the rod 68 to position either an opening 74 of the slide member 72 in alignment with the end 70 of the rod 68 or a solid section 75 of the block 72 in the manner illustrated in FIG. 11 to prevent movement of the staking or anvil member 60 relative to the female die member 57 as will be apparent hereinafter.

The block 72 is adapted to be moved horizontally in the head 24 by a piston and cylinder device 76 that has its cylinder 77 carried by the same cross piece 78 of the head 24 that provides for the guided movement of the head 24 on the posts 23 as the posts 23 are received in suitable openings 79 of the guide member 78 as illustrated in FIG. 3. Thus, a piston rod 80 of the piston and cylinder device 76 is interconnected to the sliding block 72 to cause movement of the block 72 relative to the head 24 in a manner hereinafter described.

As illustrated in FIGS. 1 and 3, the piston and cylinder device 25 has its cylinder 81 pivotally mounted to the frame 21 of the apparatus 20 by pivot means 82. The piston 83 of the piston and cylinder device 25, in turn, is pivotally mounted by a yoke member 84, FIG. 3, and pivot pins 85 to the lower ends 86 of a pair of links 87 each being pivotally mounted at the upper ends 88 thereof to the frame 21 by a pivot pin 89.

Another link 90 has its lower end 91 pivotally mounted by a pivot pin 92 to a bracket 93 secured to the guide plate 78 of the movable head 24 while the upper end 94 of the link 90 is pivotally mounted by an end member 95 to the pivot pins 85 whereby it can be seen that the adjacent ends 94 and 86 of the links 90 and 87 are pivotally interconnected to each other by the pins 85 while the other ends 88 and 91 of the links 87 and 90 are respectively pivotally mounted to the frame 21 and movable head 24, the piston and cylinder device 25 being pivotally mounted to the adjacent ends 86 and 95 of the links 87 and 90 to cause substantially straight line movement of the head 24 relative to the frame 21 in a manner hereinafter described.

Figure 4:
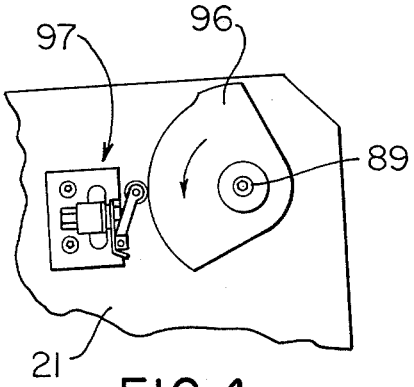
FIG. 4 is a fragmentary view taken in the direction of the arrows 4—4 of FIG. 3.

The pivot rod 89 carries a pair of cam members 96 on the opposed ends thereof which will rotate with the links 87 in a manner hereinafter described to respectively operative limit switch means 97 carried by the frame means 21 in a manner illustrated in FIGS. 1 and 4 to control the operation of the apparatus 20 in a manner hereinafter described.

Figure 2:
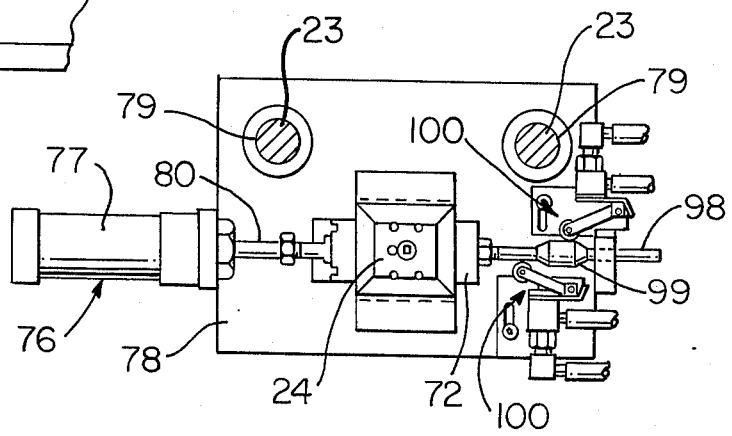
FIG. 2 is a cross-sectional view taken substantially in the direction of the arrows 2—2 of FIG. 1.

Similarly, the piston rod 80 of the piston and cylinder device 76 has an extension 98 on the right-hand end thereof as illustrated in FIG. 2 that is provided with a cam means 99 that is adapted to operate limit switch means 100 during the movement of the piston rods 80 relative to the cylinder 77 in a manner hereinafter described.

From the above, it can be seen that the apparatus 20 can be made in a relatively simple manner by the method of this invention to have the head 24 perform both the lancing and forming operation on a first stroke of the head 24 and a subsequent staking operation on a second stroke of the head 24 relative to the block 26 in a manner now to be described.

In the operation of the apparatus 20, when the piston rod 83 of the piston and cylinder device 25 is in the retracted position of FIGS. 1 and 9, the head 24 is in an up position relative to the block 26 and the block 72 being controlled by the piston and cylinder device 76 is positioned with its opening 74 in alignment with the end 70 of the rod 68 of the anvil or staking member 60 as illustrated in FIG. 9. The operator of the apparatus 20 loads the parts 27 and 28 into the block 26 in the manner illustrated in FIG. 9, the block 26 being held in its up position by the piston and cylinder device 50 to maintain the surface 51 of the block 26 flush with the upper end 52 of the punch 35 so that the parts 27 and 28 can be easily loaded in place as previously described.

Figure 10:
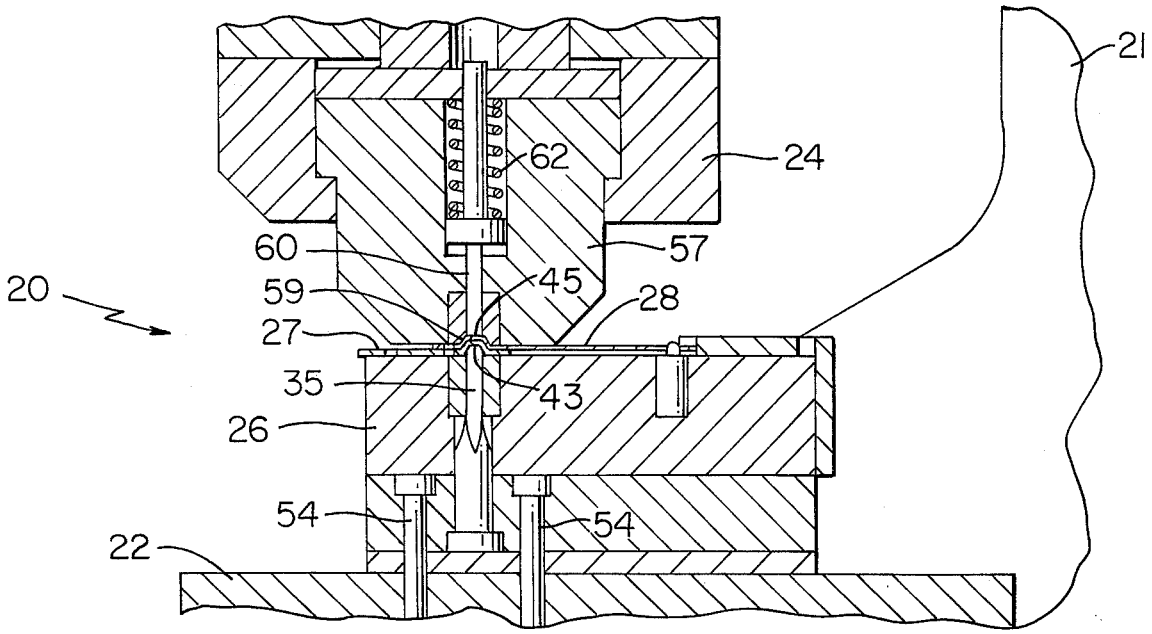
FIG. 10 is a view similar to FIG. 9 and illustrates the apparatus during the lancing and forming operation thereof.

Thereafter, the operator, through suitable safety switches and the like, actuates the control system for the apparatus 20 so that the piston and cylinder device 25 will cause the piston 83 to be extended to the lancing and forming position generally indicated by the reference L in FIG. 1 wherein the links 87 and 90 are disposed in substantially aligned vertical relation so that the head 24 is moved downwardly on the posts 23 to form the lancing and forming operation illustrated in FIG. 10 wherein the block 26 is driven downwardly relative to the stationary punch 35 so that the punch 35 causes the parts 43 and 45 of the members 27 and 28 to be lanced and formed upwardly into the cavity 59 of the female die 57 and force the anvil member 60 upwardly in opposition to the force of the compression spring 62 whereby the anvil member 60 does not interfere with the lancing and forming operation illustrated in FIG. 10.

Figure 11:
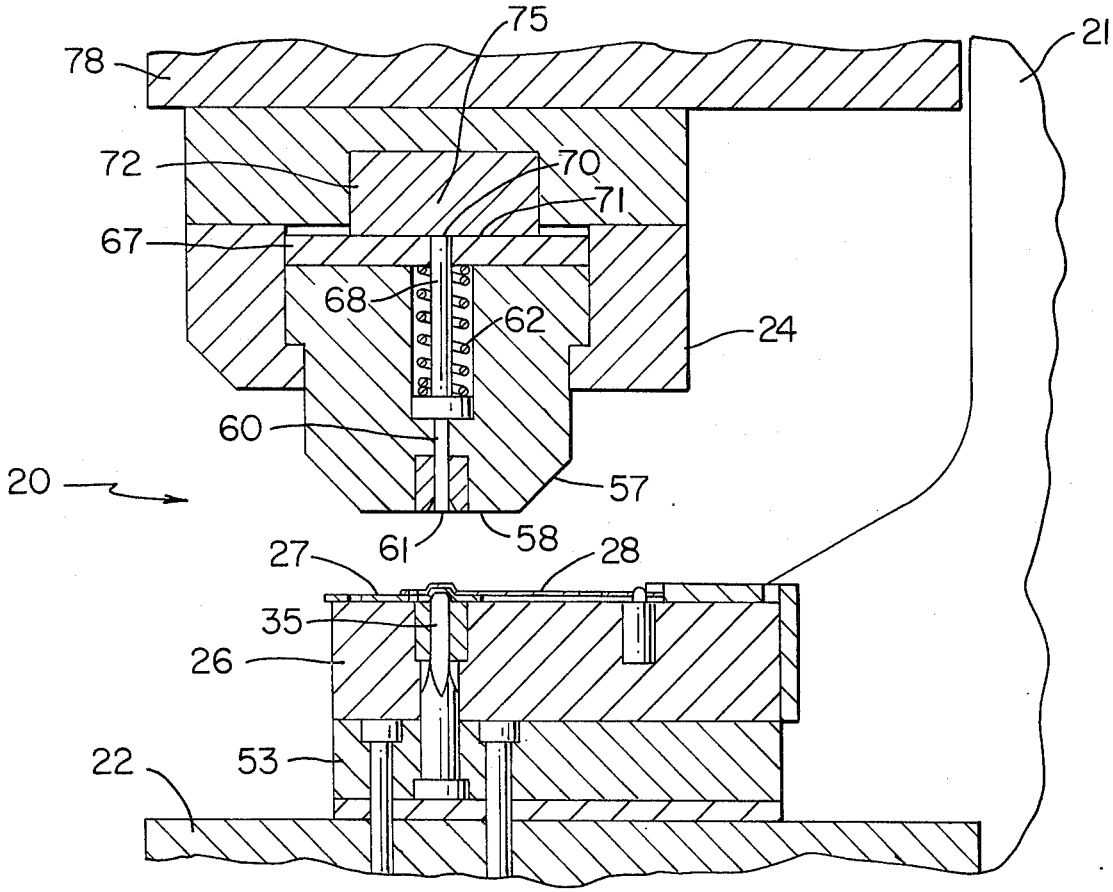
FIG. 11 is a view similar to FIG. 10 and illustrates the apparatus just before the staking stroke thereof.

After the lancing and forming operation illustrated in FIG. 10 forms the parts 43 and 45 of the members 27 and 28 as illustrated in FIG. 6, the piston 83 of the piston and cylinder device 25 continues to move outwardly to the position represented by the reference letter M in FIG. 1 which causes the ram 24 to be pulled upwardly on the posts 23 to the position illustrated in FIG. 11. By pulling the head 24 upwardly away from the block 26 from the position illustrated in FIG. 10 to the position illustrated in FIG. 11, the compression spring 62 acting on the anvil or staking member 60 is now free to move the staking member 60 downwardly so that the lower end 61 thereof is flush with the surface 58 of the female die member 57 and the upper end 70 thereof is flush with the top surface 71 of the plate 67. At this time, the piston and cylinder device 76 is actuated to cause the piston rod 80 to move the unbored part 75 of the block 72 over the end 70 of the part 68 of the anvil member 60 to prevent the same from being moved upwardly relative to the female die member 57.

Figure 12:
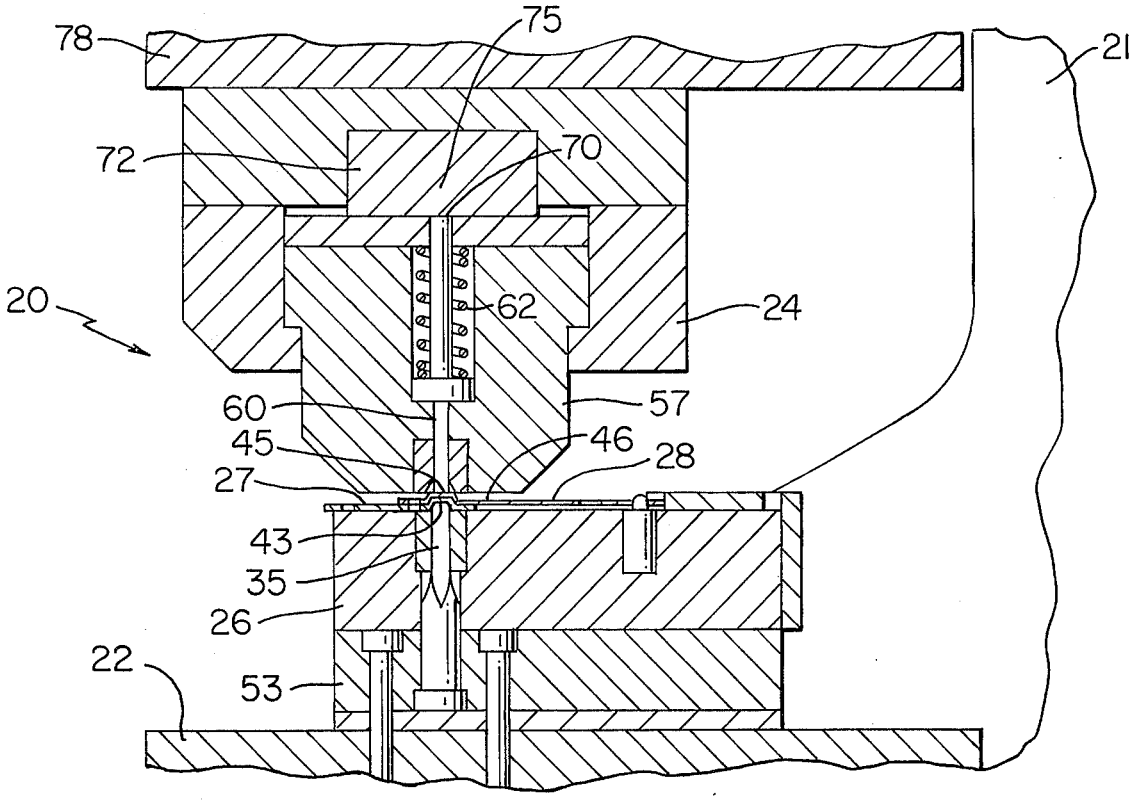
FIG. 12 is a view similar to FIG. 11 and illustrates the staking step of the apparatus of FIG. 1.

With the unbored part of the block 72 now disposed over the upper end 70 of the anvil 60, the piston and cylinder device 25 retracts the piston rod 83 thereof from the position M in FIG. 1 back to the position L in FIG. 1 whereby the head 24 is again moved downwardly to cause the female die member 57 to carry the now stationary anvil member 60 downwardly to engage against the upper lanced and formed part 45 of the switch blade 28 and thereby outwardly compress and stake the lanced and formed part 43 of the terminal 27 against the surface 46 of the blade member 28 as represented by the reference numerals 47 in FIG. 7 as the parts 45 and 43 are being compressed between the anvil member 60 and the stationary punch 35 as illustrated in FIG. 12.

Figure 13:
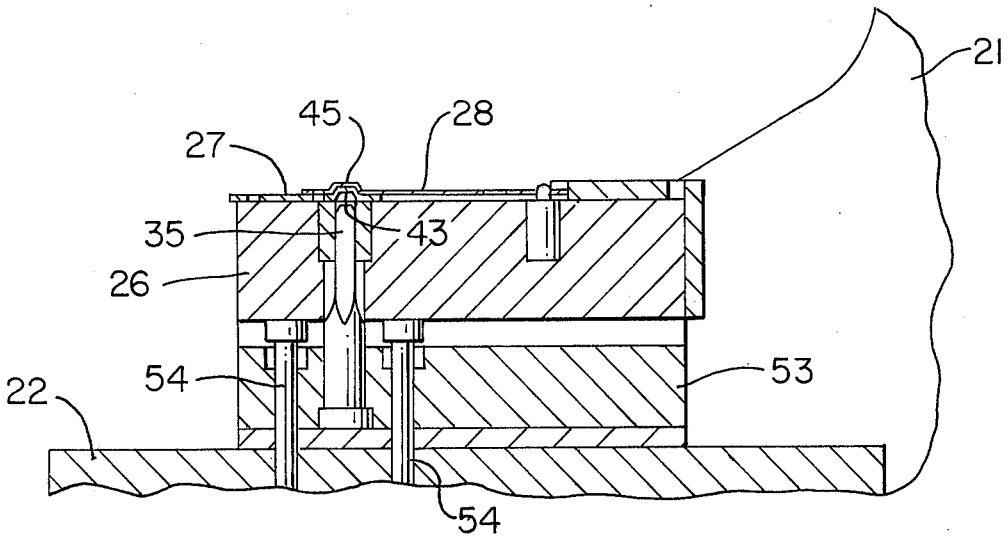
FIG. 13 is a view similar to FIG. 12 and illustrates the step for stripping the completed assembly from the apparatus of this invention.

Thereafter, the piston and cylinder device 25 further retracts the piston rod 83 back to the dashed-line position of FIG. 1 to pull the head 24 upwardly back to the position illustrated in FIG. 9 at which time the lower piston and cylinder device 50 extends its piston rod 58 upwardly to move the block 26 upwardly relative to the block 53 as illustrated in FIG. 13 to strip the now completed assembly of the parts 27 and 28 from the punch member 35 so that the completed assembly of FIG. 5 can be removed from the block 26 and new parts 27 and 28 be reassembled therein before the piston and cylinder device 25 is again operated to move the head 24 downwardly for the previously described lancing and forming operation.

Therefore, it can be seen that the apparatus 20 of this invention has a single head 24 which during a first stroke thereof performs a lancing and forming operation on the parts 27 and 28 in the manner illustrated in FIG. 10 and, thereafter, during a second stroke of the head 24 toward the block 26 will perform a staking operation as illustrated in FIG. 12.

Accordingly, it can be seen that this invention not only provides an improved apparatus for joining together two abutting metal members, but also this invention provides a method of making such an apparatus.

While the form and method of this invention now preferred have been illustrated and described as required by the Patent Statute, it is to be understood that other forms and method steps can be utilized and still fall within the scope of the appended claims.

We claim:

1. In an apparatus for joining two abutting metal members together by lancing and forming a part of one member through an unblanked part of the other member and thereafter staking said lanced and formed part of said one member to an adjacent surface of said other member to secure said members together in abutting relation, the improvement wherein said apparatus has a single reciprocating head having a first means that performs said lancing and forming step on a first stroke thereof and having a second means that performs said staking step on a second stroke thereof.

2. An apparatus as set forth in claim 1 wherein said first means of said head comprises a female die member.

3. An apparatus as set forth in claim 2 wherein said apparatus has a punch toward which said head is moved during said first stroke thereof to lance and form said metal members between said female die and said punch.

4. An apparatus as set forth in claim 3 wherein said second means of said head comprises an anvil member adapted to reciprocate in said female die member, said anvil member being adapted to compact said lanced and formed parts of said metal members between said anvil member and said punch during said second stroke of said head to perform said staking step.

5. An apparatus as set forth in claim 4 wherein said head has stop means for holding said anvil member in a fixed position relative to said head during said second stroke thereof.

6. An apparatus as set forth in claim 5 wherein said head has biasing means for tending to hold said anvil member in said fixed position thereof but permitting said anvil member to be moved inwardly in said female die member during said first stroke of said head to permit said lancing and forming step.

7. An apparatus as set forth in claim 4 wherein said punch has a stripping means operatively associated therewith, said apparatus having means for causing said stripping means to strip said staked members from said punch after said second stroke of said head.

8. An apparatus as set forth in claim 1 wherein said apparatus has a frame, said frame having means movably carrying said head to permit said head to move in substantially a straight line during said strokes thereof.

9. An apparatus as set forth in claim 8 wherein said frame carries a piston and cylinder device that is operatively interconnected to said head to cause said strokes thereof.

10. An apparatus as set forth in claim 9 wherein said frame carries a pair of links being pivotally interconnected together at adjacent ends thereof, one link having the other end thereof pivoted to said frame, the other link having the other end pivoted to said head, said piston and cylinder device being pivotally interconnected to said adjacent ends of said links to cause movement of said head through movement of said links.

* * * * *